United States Patent [19]

Menrath

[11] Patent Number: 5,013,172

[45] Date of Patent: May 7, 1991

[54] WRITING UTENSIL WITH SPACER RING

[75] Inventor: Albert Menrath, Leimen, Fed. Rep. of Germany

[73] Assignee: Hermann Boehler GmbH, Dossenheim, Fed. Rep. of Germany

[21] Appl. No.: 418,267

[22] Filed: Oct. 6, 1989

[30] Foreign Application Priority Data

Oct. 6, 1988 [DE] Fed. Rep. of Germany ..... 3834352

[51] Int. Cl.[5] ..... B43K 5/00; B43K 5/18; B43K 9/00

[52] U.S. Cl. ..... 401/133; 401/134; 401/247

[58] Field of Search ..... 401/132, 133, 134, 135, 401/247; 222/83

[56] References Cited

U.S. PATENT DOCUMENTS

| | | | |
|---|---|---|---|
| Re. 29,656 | 6/1978 | Chittenden et al. | 222/83 X |
| 3,399,019 | 8/1968 | Koelichen | 401/134 |
| 4,722,449 | 2/1988 | Dubach | 401/134 X |
| 4,770,323 | 9/1988 | Debard | 222/83 X |
| 4,781,484 | 11/1988 | Goncalves | 401/134 X |

FOREIGN PATENT DOCUMENTS

| | | | |
|---|---|---|---|
| 1187954 | 2/1965 | Fed. Rep. of Germany | 401/133 |
| 2003229 | 7/1971 | Fed. Rep. of Germany | 401/133 |
| 2380892 | 10/1978 | France | 401/134 |

*Primary Examiner*—Steven A. Bratlie
*Attorney, Agent, or Firm*—Ralf H. Siegemund

[57] ABSTRACT

A one shot use, nonreusable or nonrefillable writing implement has a writing insert with a front end writing tip and a rear end projection for perforating the closure of a writing liquid (india ink etc.) reservoir; a two part cap has an axially slidable end piece with a sleevelike extension with two beads and a cap sleeve for locking the cap in two positions; in one position the writing insert is kept from the closure and in the other one the closure is perforated, a spacer ring holds normally the end piece is held in pristine state indicating position corresponding to the first latch position on removal of the spacer ring, the end piece upon being pushed towards the cap sleeve permitting establishing the second position wherein the second one of the beads latches.

2 Claims, 1 Drawing Sheet

WRITING UTENSIL WITH SPACER RING

BACKGROUND OF THE INVENTION

The present invention relates to a one way or one shot or lost or nonreusable or, better, nonrefillable writing utensil or implement having a writing insert converable by a cap and a writing liquid (ink, India ink etc.) reservoir connected therewith and activatable prior to first use which reservoir is formed by the implement's housing and being provided with a closure that can be penetrated by a projection at the rear end of the writing insert.

Implements and utensils of the type to which the invention refers require that a purchaser and potential and actual further user can be certain that the cover of the reservoir for the ink has not been opened and is still not open when he acquires the utensil. This guarantee is given as far as the known writing utensils are concerned only if the implement does not yet have the writing portion inserted.

Another kind of writing tool such as fountain pens, ink writer, India ink drawing tools with exchangeable cartridge for the ink of one kind of another uses certain devices which are constructed to prevent the connection to the ink prior to first use. In accordance with the German petty patent 1,885,615 a spacer ring is arranged between a closing cap and the holder shaft or barrel. Only after the holder parts have been unscrewed can the spacer ring be removed. This of course provides certain safety aspect but is relatively cumbersome. The German printed patent application 1,461,601 discloses an India ink drawing tool wherein a security ring is provided between the barrel and the drawing tip. Again this kind of security and spacing ring limits any screwing of the tip into the holding barrel. The safety ring is provided with a handle by means of which the ring can be actually just pulled laterally off the tool, there being an initial pre-fracture or rupture or score line provided which facilitates completion of rupture. This is a simple way of preparing the tool prior to first use. It is however somewhat crude.

German petty patent 75 00 880 suggests a spacer ring in the form of a clamping ring or a snap ring which is inserted between the front part of the tool and the container shaft. The arrangement is for a fountain pen for ink cartridge. This device is simpler as far as assembly or disassembly is concerned and is also cheaper to make than any of the preceding devices. However, this particular arrangement is disadvantaged by the fact that following the initial removal one can turn the ring which means that even though the cartridge containing the ink has also been perforated, it is possible to provide a kind of simulated reassembly which is deceptive as it makes the implement look in the pristine state.

German petty patent 86 25 506 claims a one part opening device for premounted cartridges for a fountain pen kind of arrangement wherein an end plug can be forced in to the tool itself thereby shifting the cartridge towards the writing tip. Through a thin film kind of casting this end plug is connected with the edge or rim of the implement shaft or barrel. The advantage of this device is that the cartridge can be opened simply through extension of pressure on the plug, without having to remove any particularly configured parts.

The stated advantage however is in fact more than offset by the diadvantage that once activation has taken place and perforation of the cartridge has been completed, it is not really possible to see from the outside whether or not the pen has been used already. Simply, there is no real visible difference between an end plug whether it has been pushed and one which does not; at least from an initial impression it is not possible to tell the difference. This may not be quite correct as the pressed plug reduces the length dimensions of the implement but requires a comparison with a genuine pristine implement which again is cumbersome procedure. Alternatively, of course on opening the implement one can find out whether there was first use but again this is a rather cumbersome procedure.

German petty patent 87 16 331 discloses an implement wherein the rear end of the writing tip is held by a spacer. It is in a spaced relationship to the front end of the ink cartridge being arranged in the implement barrel. The spacer is connected with the tip and in the initial state it is covered by a cap. In order to make the writing tool ready for use a special tool is needed by means of which the spacer is separated from the tip and deformed such that the tip can penetrate fully into the barrel of the tool. Again this is a very cumbersome kind of procedure.

DESCRIPTION OF THE INVENTION

It is an object of the present invention to provide a new and improved nonreusable writing implement and utensil of the kind mentioned above and to configure such an utensil so that the first user can activate the use and connect the tip to the ink reservoir in a very simple manner, while on the other hand, if an activation that has already taken place, that fact can be ascertained very easily without having to open the implement. In other words there should be no possibility that through manipulation in one form or another a pristine state can be simulated once the tool has been put into the first use condition, while the first use should not be encumbered by a complex initiating procedure.

In accordance with the preferred embodiment of the present invention it is suggested that a writing insert (tip holder) be arranged in axially slidable relationship in a barrel that includes the ink reservoir and is covered by a two part cap having an upper axially slidable end piece with a sleevelike projection that extends into the other, main part of the cap and which sleevelike projection is then arranged around the writing tip and has a free end abutting a projection of the writing insert so that the projection can push the writing insert down and the latter will then, through an extension, perforate a closure of the ink reservoir prior to first use.

The end closure piece of the cap is secured against sliding towards the writing insert through a removable snap on safety ring being situated between that closure end piece and the main cap. The sleevelike extension of the cap end piece on one hand, and the main cap part proper on the other hand are provided with two snap locks or latches. One lock or latch prevents the end piece from being pulled out altogether, the other lock or latch is effective in that when the end piece has been pushed in, it cannot be pulled out again. Hence, the spacer ring cannot be put back to simulate a pristine utensil. For these two latches, the cap end piece is provided with two beads and there is a latcklike constriction in the cap sleeve. One of the beads establishes the latch that becomes effective after pushing in of the end piece, the other bead serves as initial latch lock, preventing the end piece from being pulled out entirely.

Thus, the spacing of the beads corresponds to the sliding and shifting length of the writing insert. The safety ring has axial dimensions which correspond to that particular displacement path and preferably the safety ring is a clamping kind of snap ring.

The advantages offered by the invention are essentially to be seen in that the device is of simple construction and simpler than the known construction and the purchaser and/or first user can easily determine with certainty whether or not the implement has already been used. In other words the entire amount of writing liquid ink etc. or India ink available so that he can make full use of the implement.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
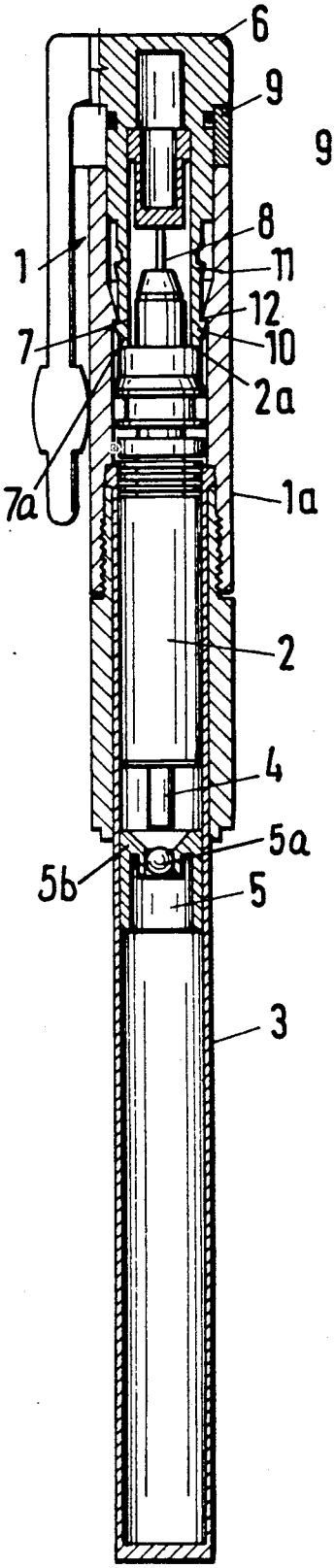
FIG. 1 is a longitudinal section view through a nonrefillable writing implement in accordance with the preferred embodiment of the present invention for practicing the best mode thereof; the implement being shown in the pristine state not having been used yet.
Figure 2:
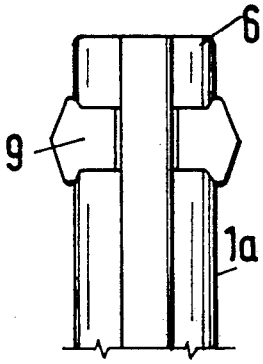
FIG. 2 is a partial view of the upper end of the cap used in the implement of FIG. 1.

Proceeding now to the detailed description of the drawings the figures show a one shot use, or nonreusable, or nonrefillable writing implement or tool with inserted ink supply, be it regular ink, India ink or any other kind of liquid dye. The utensil includes a short barrel 13 which includes and encloses the upper part of a tube 3, the lower part of which serves as ink or dye reservoir. That upper part of tube 3 which is enclosed by barrel 13 and receives, in axially slidable relation, a writing insert 2 which extends down into the barrel 13 and up therefrom into a cap 1. That barrel has a threaded upper portion onto which is screwed on one cap part or cap sleeve 1*a*. The reservoir 3 has an internal partition which is established by a closure 5 element which in turn includes a ball 5*a* that is inserted in a funnel shaped portion 5*b*. It can thus be seen that the closure 5 is a pluglike element having in addition to the funnel an opening in its center and normally the ball 5*a* closes off that opening 5*c*.

Figure 3:
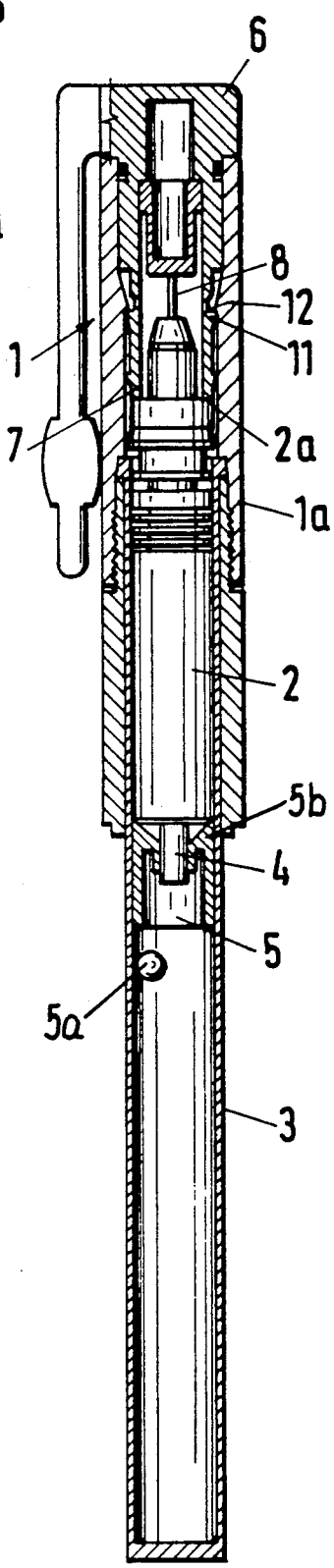
FIG. 3 is a cross section corresponding to the cross section shown in FIG. 1 but now in the activated state as far as connecting the writing tip to the ink reservoir is concerned.

As shown in FIG. 1, a projection 4 from the insert 2 hovers above the ball 5*a* and the funnel 5*b*, but as shown in FIG. 3 it can perforate and penetrate through the funnel 5*b* and push the ball 5*a* out of the way. Since the projection 4 is hollow the interior of the reservoir 3 will then be liquid conductively connected to the writing insert 2.

The writing insert is in a latch condition (latch not shown) spaced from the reservoir 3 but axially slidable in the upper part of 3 and in barrel 13. The tip 8 in the front end of the writing insert 2, to the extent that insert extends forward from 2*a* is covered by the cap 1. This cap 1 has the lower part 1*a* that was already mentioned; the upper end of cap 1 is provided separately but as an axially slidable, end closure piece or cap sleeve 6 which in turn is provided with a tubular or sleevelike extension 7. Extension 7 extends into the cap part or cap sleeve 1*a*. This sleevelike projection or extension 7 encloses, so to speak, the writing tip 8 while the end 7*a* of projection abuts projection 2*a* of the writing insert 2.

The cap's end piece 6 is prevented from being pushed towards and onto the writing piece 2 by means of a safety ring 9 which is arranged between the end piece 6 on one hand and the cap sleeve 1*a* on the other hand. The ring 9 has an axial extension 9*a* which corresponds to the displacement path of the insert 2 (compare FIGS. 1 and 3) for the reservoir opening state.

The sleevelike projection 7 of the end piece 6 of cap 1 is in addition provided with two beads 10 and 11 which as will be explained more fully below. They cooperate with a latchlike narrowing or constriction 12 in the cap sleeve 1*a*. The axial spacing between the two beads 10 and 11 moreover corresponds to the length of the displacement path of the writing insert 2 which, as was mentioned above corresponds in turn to the axial dimension of the ring 9. The particular constructive features of the implement each are fulfilling specific functions and the overall function makes sure that unauthorized premature use is detectable.

Figure 4:
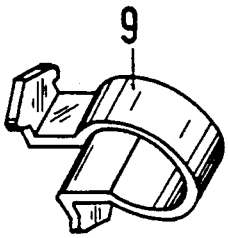
FIG. 4 is a perspective view of the safety ring arranged in the upper part as shown in FIGS. 1 and 2 but no longer in FIG. 3.

The safety ring 9 as arranged between the end piece 6 of cap 1 and the cap sleeve 1*a* prevents a relative shift of the end piece 6 towards the writing insert 2. This means that the projection 4 is safely spaced from the closure plug 5 for the liquid containing reservoir 3. FIG. 4 illustrates the ring 9 in greater detail. Normally, the bead 10 is lodged behind latch constriction 12. The bead 10 and sleeve 7 can be moved down but the latch prevents the end piece 6 from being pulled off and out of cap sleeve 1*a*.

Upon removing ring 9, the end piece 6 can be pushed into the cap sleeve 1*a* and that in turn pushes the insert 2 down whereupon the projection 4 penetrates the closure 5. Now the tubular projection 4 admits ink to flow through a channel in the interior of the insert 2 to the tip 8. FIGS. 1 and 3 indicate a chamber system effective in the interior of the writing insert 2 which cooperates with the ink channel therein and provides particularly any kind of equalization and compensation of excess pressure as it may arise inside the liquid reservoir 3.

As the end piece 6 is pushed down and moves the insert 2, cap sleeve 1*a* remains in position because it is screwed onto barrel 13. The bead 10 of projection or sleeve 7 of the end piece 6 determines the upper position of the piece 6. Also determined in that fashion is the position insert 2 has prior to push down. Now, after the activation of the reservoir 3 i.e. after the shifting of the insert 2 which in turn is after the opening or closure of 5, the bead 11 is latched behind the constriction 12, now locking end piece 6 in the pushed-down position.

Prior to the activation, as just described bead 10 with constriction 12 and ring 9 keep everything safely in position, and particularly extension 4 is kept safely above the closure 5, so that on normal manipulation and handling of the unactivated implement it is not possible for the insert 2 to accidentally cause the communication between the ink channel in the reservoir 3 and the tip 8 to be established.

After the ring 9 has been removed and after the end piece 6 has been pushed inwardly, the pushing moves the bead 10 out of the constriction 12 and instead the bead 11 latches behind the constriction 12. In either situation and owing to the particular configuration of the construction of the beads, the end piece 6 cannot be retracted. Hence once the end piece 6 has been pushed in, no manipulation will permit its retraction owing to the latch operation of the bead 11 behind 12. Hence there is no possibility to simulate a pristine state of the utensil. On the other hand the geniune pristine state is directly indicated by the presence of the safety ring 9.

The invention is not limited to the embodiments described above but all changes and modifications thereof, not constituting departures from the spirit and scope of the invention, are intended to be included.

What is claimed is:

1. A one shot use, such as nonreusable and/or nonrefillable writing implement comprising:

a holder barrel with inserted writing insert, said writing insert having a front end with a writing tip and having a rear end with a tubular projection, the insert being movable in said barrel;

a writing liquid (India ink etc.) reservoir of tubular configuration and extending rewardly in relation to said writing tip and from said barrel;

a closure element being part of and connected to said reservoir and being axially aligned but prior to use normally spaced from said projection, and said insert situated in said barrel such that upon sliding towards said reservoir said projection is capable of penetrating and perforating said closure element to thereby provide an ink-liquid-conductive relation between the interior of the reservoir and the writing insert including the tip;

a two part cap on said barrel and having an end piece as one of its parts being axially slidable in a sleevelike cap portion being the other part, said sleevelike cap portion being connectable and disconnectable from said barrel;

said end piece of said cap having a sleevelike portion with two beads defining two relative positions vis-a-vis the cap sleeve, said cap sleeve having constriction means for latching behind one or the other of the beads to thereby establish two definite positions of the end piece vis-a-vis the cap sleeve which in turn establishes two different positions for the writing insert owing to the engagibility of the sleevelike portion of the end piece with the writing insert;

one of the positions being a position of axial displacement of the projection of the writing insert from the closure and the other one being a position of penetration and perforation of said projection vis-a-vis said closure element; and a spacer ring normally maintaining in a pristine unused state in that said end piece is held in a first axial displaced position vis-a-vis said cap sleeve corresponding to a first latch position between one of the beads and said constriction, on removal of said on spacer ring, said end piece upon being pushed towards the cap sleeve permitting establishing the second position wherein the second one of the beads latches behind the constriction and the projection of the writing insert opens through perforation said closure.

2. Implement as in claim 1, the ring being a snap-on ring.

* * * * *